United States Patent [19]

McClune

[11] Patent Number: 4,591,216

[45] Date of Patent: May 27, 1986

[54] GROUNDING SHIELDED CABLE CONNECTOR ASSEMBLY

[75] Inventor: Glen E. McClune, So. Milwaukee, Wis.

[73] Assignee: Cooper Industries, Inc., Houston, Tex.

[21] Appl. No.: 631,657

[22] Filed: Jul. 17, 1984

[51] Int. Cl.[4] ..... H01R 17/04

[52] U.S. Cl. ..... 339/14 R; 339/94 C; 339/126 J; 339/177 R

[58] Field of Search ..... 339/177 R, 177 E, 126 J, 339/14 R, 14 L, 14 P, 94 C, 130 C

[56] References Cited

U.S. PATENT DOCUMENTS

| | | | |
|---|---|---|---|
| 2,762,025 | 9/1956 | Melcher | 339/177 R |
| 3,683,320 | 8/1972 | Woods et al. | 339/130 C |
| 4,022,966 | 5/1977 | Gajajiva | 339/14 R |
| 4,126,372 | 11/1978 | Hashimoto et al. | 339/177 E |

*Primary Examiner*—John McQuade

*Attorney, Agent, or Firm*—Nelson A. Blish; Eddie E. Scott; Alan R. Thiele

[57] ABSTRACT

A grounding shielded cable connector assembly is disclosed which is easily assembled and establishes a highly conductive path to ground through two mechanical junctions in the assembly. The assembly is adapted to provide good mechanical and electrical connections between a shielded cable and a grounded metal enclosed cabinet while maintaining adequate protection against deleterious aspects of the environment. A mechanical junction between a cable shield and a cable coupling is achieved by a spring clip and retaining means structure of the coupling to establish a highly conductive electrical junction. A mechanical connector junction between the cable coupling and a cabinet connector, adapted to secure the cabinet connector on a cabinet, is established by a threaded connection. As the cable coupling and cabinet connector are screwed together a high conductivity butting junction is established between them. A hollow plug is threadably connected to the cable coupling and provides a sealed mechanical connection between a cable sheath and the assembly. An 'O' ring seal provides environmental protection on the interior of the assembly by being trapped between surfaces on the plug and cable coupling.

7 Claims, 4 Drawing Figures

GROUNDING SHIELDED CABLE CONNECTOR ASSEMBLY

BACKGROUND OF THE INVENTION

This invention relates to the field of electrical connectors. More particularly, the present invention relates to electrical connectors for grounding large surge currents conducted by the braided shield of a multiple conductor cable.

Electronic controls for power distribution switchgear are considerably less resistant to damage and malfunction from overvoltage and overcurrent conditions than the switchgear they control. The electronic controls typically operate with voltages in the decades and currents in the same range or less. Distribution switchgear typically switches voltage in the decade kilovolt range and currents of hundreds of amperes or more. Distribution switchgear is often exposed to hazardous overvoltages and overcurrents due to a number of causes. A leading cause of such electrical hazards is lightning striking near the switchgear. To reduce the adverse effect of lightning, arrestors are frequently connected between the distribution line and ground to limit the overvoltage and shunt the surging overcurrent away from the protected equipment to ground. In accordance with good practice, the metal enclosed housings of the switchgear and the control are also grounded. An ideal grounding conductor would prevent the point grounded from ever rising above the ground voltage level, regardless of the current it conducts. They don't exist. Grounding conductors have finite current carrying capability and may melt, or overheat adjacent components unless considerable care is taken. Likewise, their finite conductivity allows a point connected to ground to rise in voltage, which can overstress the components to be protected.

The preferred method of grounding switchgear protected by an arrestor, and a control is to separately ground the arrestor, separately ground the switchgear and, ground the control through the grounding connection of the switchgear. Although the preferred grounding method is usually employed by users, national testing authorities require testing under a worst case approach to test resistance to a fault conditions. Arrestor flashover caused by lightning with associated surge currents are simulated by spark gap flashover. Worst case grounding (as set forth ANSI/IEEE specification C37.60–1981) is employed by connecting the arrestor to the grounding conductor of the switchgear. The control is separately grounded.

The grounding schemes thus far discussed relate to power grounds which are designed to carry significant levels of current when a fault occurs or an arrestor breaks over. It can reasonably be anticipated that the point to be grounded will, under fault conditions, rise several volts above ground. Such a faulted voltage rise would reck havoc in a control receiving and issuing signals in a similar voltage range. To avoid the confusion between valid signals and fault noise, a signal ground conductor between the control and associated switchgear is typically run separately from the power ground conductor to establsh a ground reference for signals. For older controls, one of the conductors in the cable connecting the switchgear and the control provided a signal ground.

More recently, as part of the trend to integrated circuits from discrete components, the voltage operating level of most of the control has been markedly decreased and signal processing speed increased. As a result, recent controls are more noise sensitive. Because a grounded conductor in a cable couples significant noise into adjacent conductors under fault conditions, using one of the conductors in a cable is not viable for the recent generation of controls.

A shielded cable with the shield grounded has been used to connect the switchgear and a recent type control. In addition to reducing the level of noise coupled into the conductors embraced by the braided shield under fault conditions, a grounded braided shield protects the conductors from adverse electric field conditions.

In one development, a prototype grounding shielded cable connector assembly included a cabinet connector, an aluminum plug, and a cable coupling. The cable shield was secured to a portion of the conductive cable coupling by a flat annular bronze spring and was also electrically secured to the cabinet connector by a jumpered connection. The principal path for ground current was through the cable coupling, into and out of a bronze current exchange spring bridging the annular space between the cable coupling and plug, and lastly through the plug to the threaded connection between the plug and a grounded cabinet connector. Unfortunately, the prototype assembly would not pass the ANSI/IEEE specification C37.60–1981, even when additional surge protection was incorporated into the cabinet connector. It is believed the failure of the prototype connector was caused by its use of three mechanical junctions, employing point contacts and dissimilar metals across junctions. Additionally the prototype was labor intensive.

SUMMARY OF THE INVENTION

The present invention of a connector assembly physically secures the cable to the switchgear and control, provides a degree of protection from adverse environmental conditions and provides surge withstand capability under ANSI/IEEE test specification C37.60–1981. The present invention includes a number of relatively inexpensive components which are readily assembled into a grounding shielded cable connector. A cabinet connector meeting MIL-C-5015 specification was selected to secure the assembly to a metal enclosure. The cabinet connector itself is an assembly of four components; a cabinet receptacle, a cabinet coupling, a cabinet gasket, and a cabinet plug. The receptacle is a flanged hollow cylinder threaded on one exterior end. It is secured to a metal cabinet with screws which are received in the receptacle flange. The plug is also a hollow cylinder which is partialy contained within the receptacle. A flange on the plug locates the gasket between the receptacle and the plug flange. The uncontained end of the plug protrudes towards the exterior of the cabinet and is threaded on its outer surface. The coupling screws onto the receptacle to retain the plug in place by trapping the plug flange and gasket between the coupling interior shoulder and the receptacle end. An aluminum cable coupling with mating threads is screwable onto the receptacle plug to form a butting junction between the annular uncontained end of the plug, and an interior shoulder of the coupling. The threaded connection is coated with a sealing compound to inhibit penetration of the assembly interior by adverse environmental factors. At the other end of the coupling, retaining means structure in cooperation with a snaap ring secures the shield of the cable to the cable coupling. In completing the electrical connections between the cable and the receptacle, the conductors are fed through the interior of the coupling to conductor pins in the receptacle plug and the shield is drawn over the narrow diameter of the coupling containing the retaining means structure. The cable coupling provides the surge current path to the receptacle through two large surface contacts avoiding the undesirable point junctions and reducing the number of junctions previously used. Near the middle of the cable coupling, at the end of its largest diameter adjacent to its reduced diameter, threads provide a securement for a hollow plug assembly which secures the cable sheath to the connector assembly and guards the junction between the shield and cable coupling. The joint between the plug and cable coupling is sealed by an elastomeric 'O' ring. At the other end of the plug, the cable sheath is secured by a sealin fastener. The sealing fastener comprises a seal coupling which screws onto the plug, a beveled washer and an elastomeric annular wedge. As the seal coupling is tightened, the annular wedge is drawn radially and longitudinally to the interior of the plug to sealingly secure the cable sheth.

DETAILED DESCRIPTION OF THE DRAWING

Figure 1:
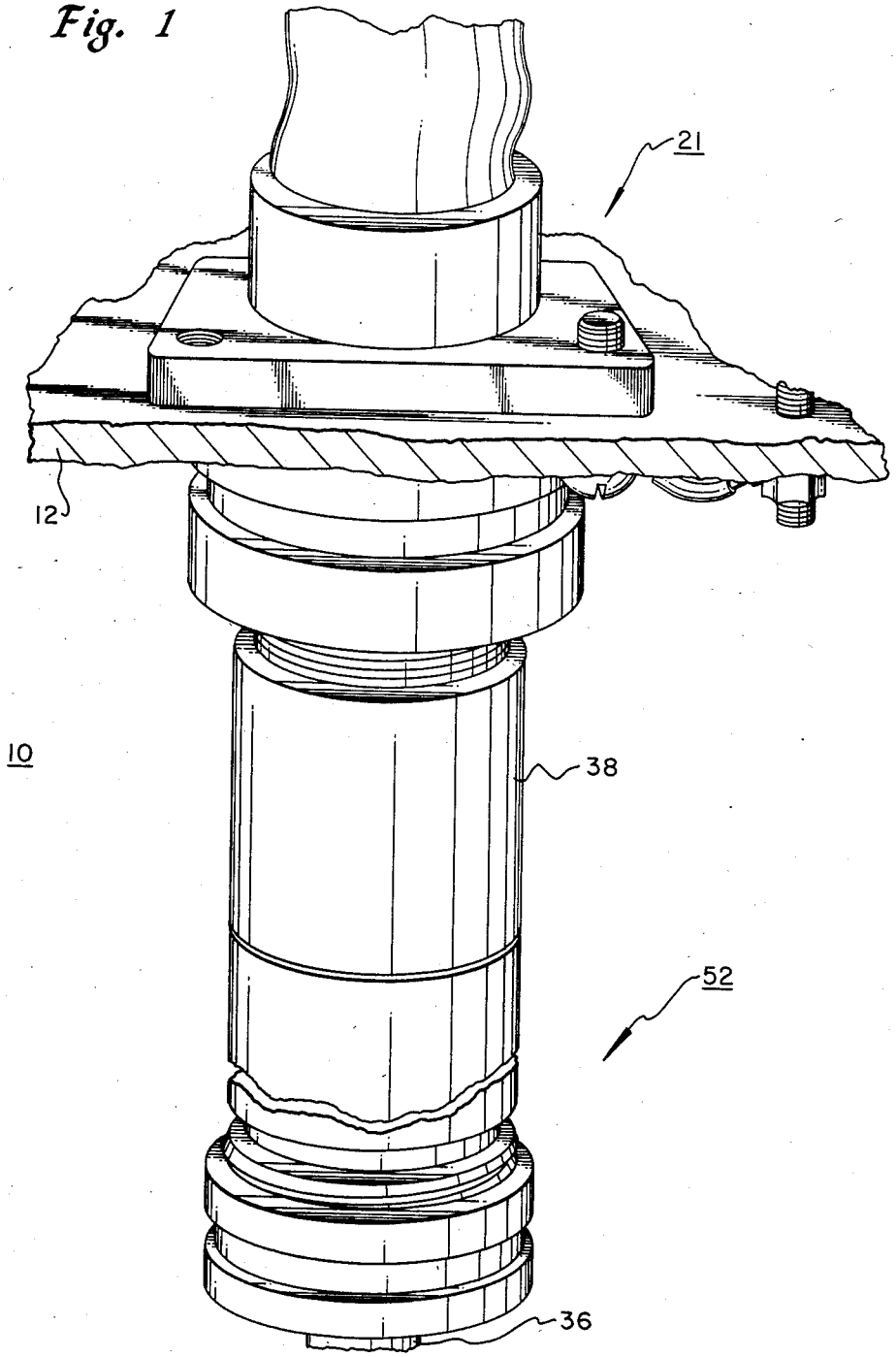
FIG. 1 is a perspective view of the connector assembly of the invention and an associated section of a metal enclosure.

FIG. 1 shows my invention of a grounding shielded cable connector assembly 10 in perspective view with an associated portion of a metal enclosure 12.

Figure 2:
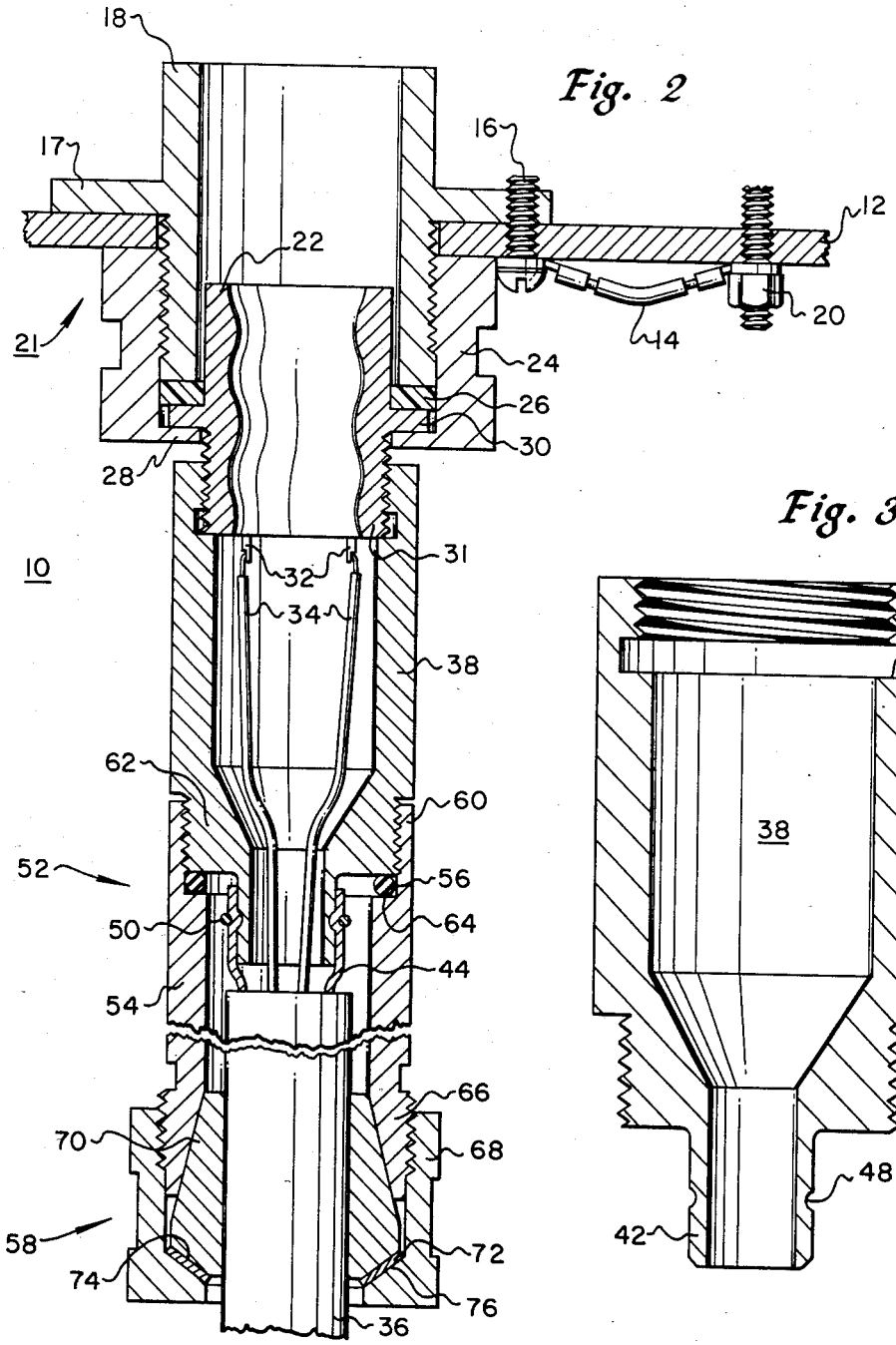
FIG. 2 is a cross-sectional view of the structure of FIG. 1.

FIG. 2 is a cross section taken along a longitudinal axis of assembly 10. The metal enclosure 12 supports assembly 10 and provides a parallel grounding conduction path for surge current to that established by a jumper 14. Jumper 14 is secured to assembly 10 through a receptable bolt 16 attached to cabinet receptacle flange 17. The other end of jumper 14 is secured to a ground bolt 20 where a grounding cable can be connected. Cabinet receptacle 18 is one component of cabinet connector subassembly 21 which is secured to the metal cabinet by screws received in cabinet receptacle flange 17. Subassembly 21 is a MIL specification cabinet connector which also includes a cabinet plug 22, a cabinet coupling 24, and a cabinet gasket 26. Cabinet plug 22 is partially secured within receptacle 18 by coupling 24 which is threaded to receptacle 18. As coupling 24 is screwed on to receptacle 18 an interior coupling shoulder 28, at the unthreaded end of coupling 24, engages a plug flange 30 near the middle of plug 22. Cabinet gasket 26 which is an elastomeric ring of rectangular cross section lies on the unengaged side of plug flange 30 and, seals the joint between plug 22 and receptacle 18 as coupling 24 is tightened when the subassembly 21 is completed. A threaded exterior end 31 of plug 22 provides a fastening point for the remainder of connector 10. Connector pins 32 protruding through plug 22 individually receive conductors 34 of the shielded cable 36. Only two conductors 34 and pins 32 are shown in the drawing as an aid to clarity. Cable coupling 38 is shown assembled to cabinet connector subassembly 21 in FIG. 2 and alone in enlarged cross section in FIG. 3. Coupling 38 is a complex form machined from aluminum.

Generally, coupling 38 is a hollow cylinder having a large diameter end 40 to fit over the exterior of end 31 of plug 22, and a small diameter end 42 which is adapted to be inserted into cable shield 44 without causing undue shield distortion. In addition to protecting the connections between pins 32 and conductors 34, coupling 38 provides a superior surge current path between shielded cable 36 and cabinet plug 22.

Large diameter end 40 is threaded with interior threads which complement those of plug 22 and also contains interior coupling shoulder 46. As cable coupling 38 is threaded onto plug 22, coupling shoulder 46 forms a large surface electrical butting junction of high conductivity with threaded plug end 31.

Figure 3:
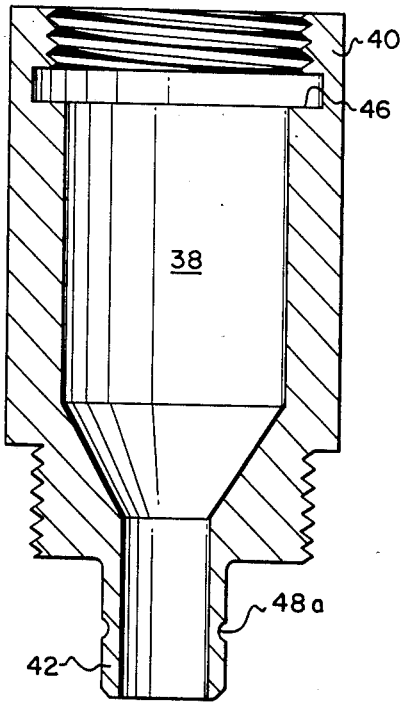
FIG. 3 is an enlarged cross-sectional view of a cable coupling component of the invention shown in FIG. 2.
Figure 4:
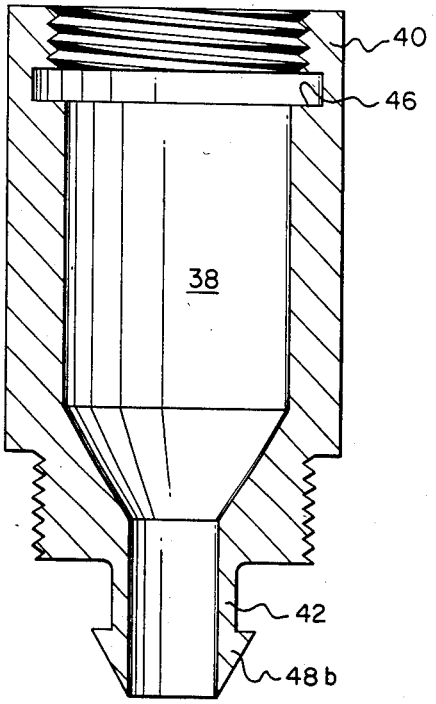
FIG. 4 is a cross-sectional view of an alternate preferred embodiment of the cable coupling component of the invention.

Adjacent to small diameter end 42 retaining means structure **48*a* is formed. Retaining means structure 48*a* in cooperation with spring clip 50 establishes a secure mechanical joinder between cable coupling 38 and cable shield 44. FIGS. 2 and 3 illustrate one embodiment of retaining means structure as a groove 48*a*. Snap ring 50 should be chosen to be of an appropriate diameter to force shield 44 into grove 48*a*. An alternate and preferred embodiment of retaining means structure is shown in FIG. 4 as a beveled shoulder 48*b*. Cable 44 is drawn over shoulder 48*b* and retained by snap ring 50 to the interior of coupling 38. In both embodiments, similarly to the electrical connection between coupling 38 and plug 22, the relatively high conducive electrical connection between coupling 38 and shield 44** has a comparatively high surface area.

The electrical connection between coupling 38 and shield 44 is protected by a plug assembly 52 which also mechanically secures the sheath of shielded cable 36 to connector assembly 10. Plug assembly 52 includes a plug 54, elastomeric annular environmental seal 56 and sealing fastener 58. Plug 54 is a hollow cylinder threaded at each end. Interior threads, at coupling end 60, complement exterior threads at a end 62 of larger diameter portion of coupling 38 furthest from the butting junction to cabinet connector subassembly 21. Adjacent to coupling end 60 of plug 54, an annular interior shoulder 64 is longitudinally spaced from the interior threads. To form a sealed joint between coupling 38 and plug assembly 52, plug 54 is screwed onto coupling 38 to trap "0" ring seal 56 between shoulder 64 and large diameter end 62 of coupling 38. At the opposite seal end 66 of plug 54, exterior threads are formed to mate with sealing fastener 58 and the hollow interior of plug 54 is beveled outwardly.

Sealing fastener 58 is a jam nut assembly of seal coupling 68, annular wedge 70 and bevel washer 72. The larger outer surface of elastomeric annular wedge 70 is tapered to complement the bevel of plug 54. Annular wedge 70 surrounds the sheath of cable 36 and is surrounded by seal coupling 68. Interposed between a reverse beveled surface 74 of annular wedge 70 and, an interior beveled shoulder 76 of seal coupling 68 is beveled washer 72. As seal coupling 68 is screwed on the exterior threads of plug 54, annular wedge 70 is drawn longitudinally and radially to the interior of plug 54 to sealingly secured the sheath of cable 36.

In the foregoing manner the present invention provides an easily fabricated grounding shielded cable connector which conducts surge currents without causing deterioration of electronic controls under adverse conditions. The connector provides secure and protected connections between a shielded cable and metal cabinet.

It should be readily understood that various modifications, changes and variations may be made in the arrangement, operation and details of construction of the elements disclosed herein without departing from the spirit and scope of this invention.

I claim:

1. A grounding shielded cable connector assembly comprising:

a cabinet connector adapted to be supported by a cabinet for establishing a highly conductive path to ground, said cabinet connector being threaded at a distal end;

a cable coupling having threads at one end engageable with the threads of said cabinet connector for securing said cable coupling to said cabinet connector to establish a highly conductive butting junction between them, said cable coupling having a fixed electrically conductive generally cylindrical portion projecting from its end furthest from the butting junction for receiving a shield of a shielded cable in sleeved relationship over said cylindrical portion without adversely affecting said shield;

an annular shield fastener for releasably securing said shield to said cylindrical portion to form a mechanical junction between said shield and said cable coupling which provides a highly conductive electrical junction between said shield and said cable coupling;

a hollow plug slidable over said cable and threadedly engageable with said cable coupling at one end of said plug to fasten said plug to said cable coupling and enclose said cylindrical portion, said plug being adapted at its other end to receive a sealing fastener; and a sealing fastener adapted to secure said cable to said plug in a sealing fashion upon assembly of said plug to said cable coupling.

2. A grounding shielded cable connector assembly as claimed in claim 1 wherein:

said shield fastener is a spring clip.

3. A grounding shielded cable connector assembly as claimed in claim 2 wherein said cable coupling additionally has shield retaining means located on said cylindrical portion cooperable with said fastener for retaining said shield on said cylindrical portion.

4. A grounded shielded cable connector assembly as claimed in claim 3 wherein said shield retaining means is a beveled shoulder tapering to its smallest diameter at the end of said cable coupling furthest from said cabinet connector.

5. A grounding shielded cable connector assembly as claimed in claim 3 wherein:

said retaining means is an annular groove; and said spring clip has a circular cross section of a diameter appropriate to force said cable shield into said annular groove in said cable connector.

6. A grounding shielded cable connector as claimed in claim 1 including:

means forming an annular environmental seal adapted to seal a nearly butting joint between said plug and said cable coupling.

7. A grounding shielded cable connector assembly as claimed in claim 1 wherein:

said sealing fastener comprises a jam nut assembly including a seal coupling and annular wedge; and including an annular environmental seal adapted to seal a nearly butting joint between said plug and said cable coupling on the interior of said junction wherein said annular environmental seal is an elastomeric "0" ring.

* * * * *